United States Patent [19]

Eckstein et al.

[11] 4,085,534

[45] Apr. 25, 1978

[54] DATA CARRIER HOLDER

[75] Inventors: Werner Willi Gustav Eckstein, Coburg, Neuses; Dieter Klaus-Jürgen Schweinsberg, Lautertal-Unterlauter, both of Germany

[73] Assignee: Eichner Organisation KG, Coburg, Germany

[21] Appl. No.: 687,595

[22] Filed: May 18, 1976

[30] Foreign Application Priority Data

Dec. 18, 1975 Germany ..... 2557065

[51] Int. Cl.[2] ..... G09F 1/10

[52] U.S. Cl. ..... 40/124.2; 40/374; 40/405

[58] Field of Search ..... 40/124, 124.2, 104.19, 40/104.06

[56] References Cited

U.S. PATENT DOCUMENTS

| | | | |
|---|---|---|---|
| 1,047,840 | 12/1912 | Reynolds | 40/124.2 |
| 1,801,804 | 4/1931 | Dawson | 40/124.2 X |
| 2,963,808 | 12/1960 | Guichard | 40/124.2 |
| 3,507,064 | 4/1970 | Hammero | 40/124.2 |
| 3,777,795 | 12/1973 | Graetz | 40/124.2 X |

FOREIGN PATENT DOCUMENTS

| | | | |
|---|---|---|---|
| 555,477 | 6/1957 | Italy | 40/104.06 |

*Primary Examiner*—Louis G. Mancene
*Assistant Examiner*—Wenceslao J. Contreras
*Attorney, Agent, or Firm*—Watson, Cole, Grindle & Watson

[57] ABSTRACT

Holder for data carriers and procedure for manufacturing such a holder. The holder includes a plurality of members, each being approximately rectangular in shape. Through the provision of a tongue and slot on each member, the members can be arranged into an overlapping arrangement with the tongue of one member being secured in the slot of the adjacent lower member. Clamping members are then used to secure the lateral sides of the members together so as to form a unit.

1 Claim, 2 Drawing Figures

DATA CARRIER HOLDER

BACKGROUND OF THE INVENTION

The present invention relates to a holder having a plurality of overlapping slip-in compartments for the filing of data carriers, such as microfiche cards, magnetic cards, film sheets, and a process for manufacturing such a holder.

In the case of the known holders, the sheets or pockets forming the slip-in pockets are generally formed of rectangular members which are secured in fixed positions by a heating sealing process. The members forming the compartments are usually not very flexible and thus it can be difficult to insert the data carriers into the compartments. Furthermore, the required heat sealing, or as a possible alternative gluing, process in manufacturing the holders is cumbersome.

SUMMARY OF THE INVENTION

An object of the present invention is to simplify the manufacturing process of the data carrier holder as compared to the procedures previously utilized.

Another object of the present invention is to produce a data carrier holder having several special advantages over precious holder as discussed above.

These objectives are achieved by forming the holder in accordance with the present invention. The holder is formed by utilizing a plurality of pieces of material, which are approximately rectangular in shape and are preferably made of plastic, each of thse rectangular members has a projecting tongue at its lower edge and a laterally extending slot positioned above the tongue, with the slot having a width corresponding to that of the tongue, but at least as wide as the tongue. The members are put together by inserting the tongue of one member into the slot of the member below it. A filing compartment for receiving the data carriers is formed between adjacent members. A series of the members are arranged in this overlapping manner until the desired number of compartments are provided. The overlapping members are then united by means of clamping bars which transverse the laterial edges of the members so as to form the holder.

This procedure for manufacturing the holder has the advantage that the respective requirements with regards to the division and slip-in depth of the compartments can be easily taken into account by changing the position of the slot, i.e., by moving the slot further towards the top or further down towards the lower edge of the respective member. Thus, the slip-in depth of the compartment is always determined by the relationship of the tongue inserted within the slot in the member directly below it.

In the preferred embodiment of the present invention, the members have fastening flaps along their lateral sides in their lower range. These fastening flaps are held by the clamping bars for securing the members in a unit so as to form the data carrier holder. In comparison with the previously known holders which have their compartment forming members tightly stretched along the entire lateral lengths, the arrangement of the present invention has the considerable advantage that the members forming the compartments can press against each other in a flexible manner along their upper portions, which are self-supporting, by providing them with a slightly convex shape. Thus by their own action the members hold the films or cards tightly in place and prevent them from falling out or being pushed out due to an awkward movement of the hand.

In order to prevent this flexible pressing action of the members against each other, which occurs in conjunction with the closing pressure of the compartments, from having a negative effect when slipping-in the films or cards, in further accordance with the present invention, at least one of the upper corners of the member can be beveled so as to facilitate the insertion of the films and cards. Additionally, the upper front edge of the pieces can be slightly bent at an angle towards the outside in order to further facilitate the insertion of the films or cards since, in this way, the tension on the upper slip-in edge is removed.

DESCRIPTION OF THE PREFERRED EMBODIMENT

Figure 1:
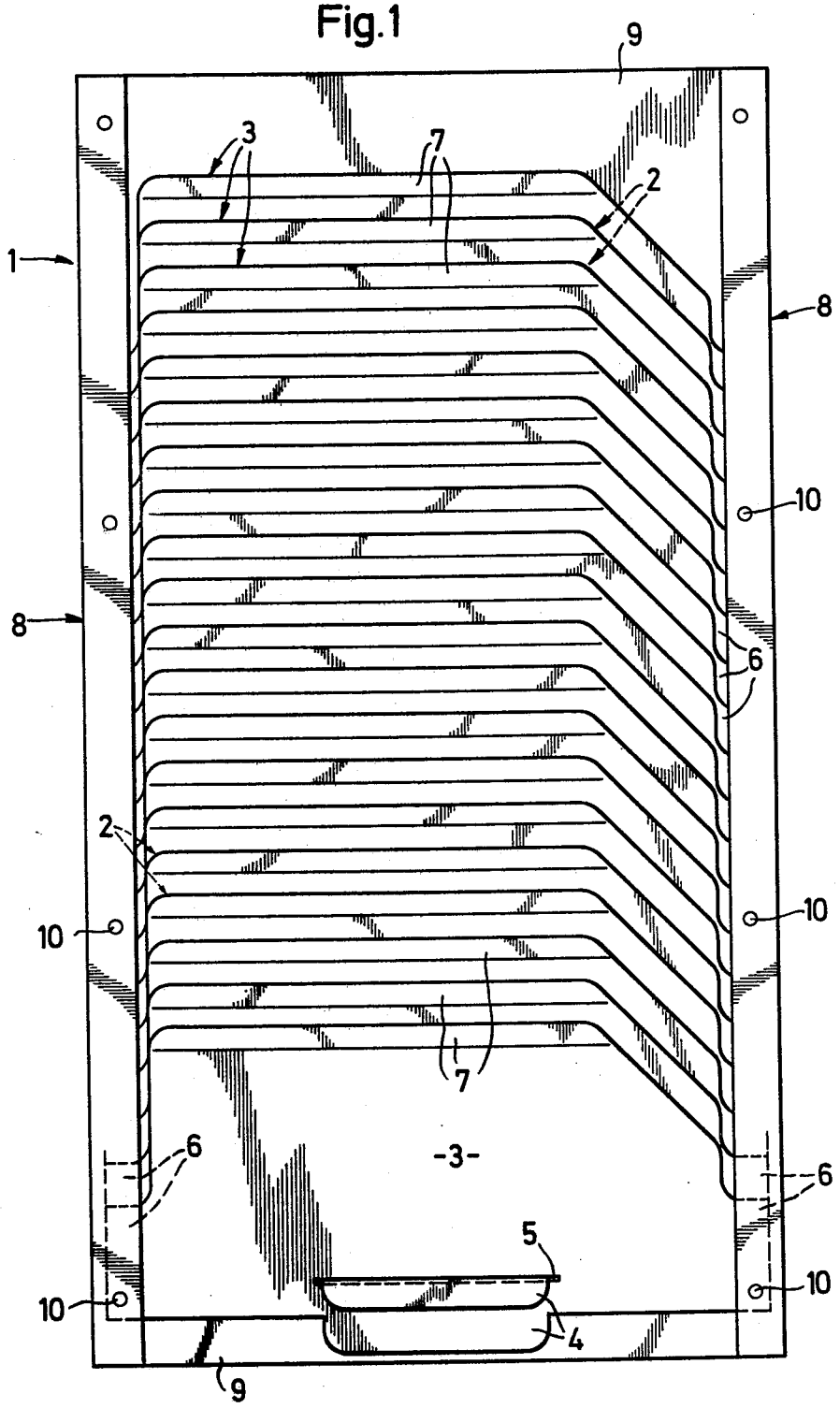
FIG. 1 shows a front view of a card holder in accordance with the present invention.
Figure 2:
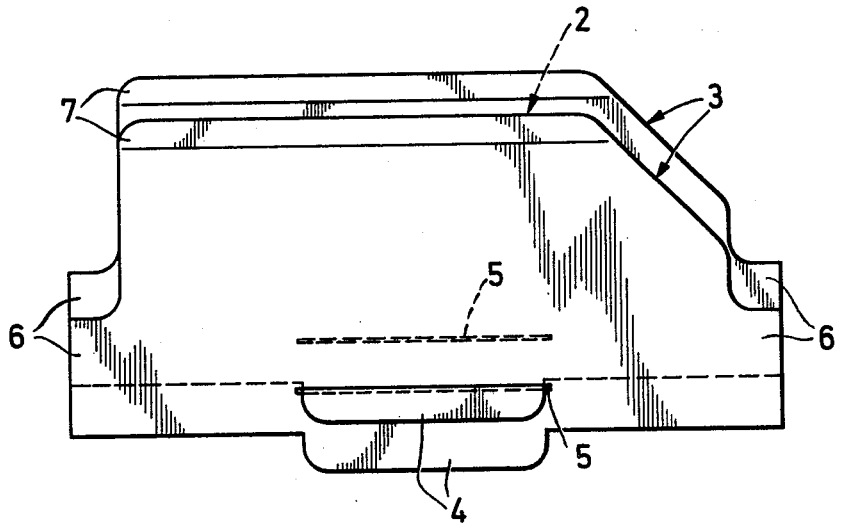
FIG. 2 illustrates two pieces of material arranged in the desired overlapping relationship.

As shown in FIG. 1, a card holder 1 has a large number of slip-in compartments 2 which are formed by pieces of material 3 secured together in an overlapping arrangement. Pieces of material 3 are approximately rectangular in shape and each possess a projecting tongue 4 at its lower edges and, above the tongue, a slot 5 with a width approximately the same, but at least as wide, as the width of the tongue. Along the lower third of its lateral edges, each of these rectangular members, 3, has fastening flaps 6 projecting on both sides. Each member is also beveled at both of its upper corners, although it can be more predominantly beveled along one side, such as the right as shown, and its upper front edge 7 is bent outwardly at a slight angle.

The pieces of material, i.e., the rectangular members 3, are secured together to form a data carrier holder by inserting tongue 4 of one member into slot 5 of the adjacent lower member.

After having produced the desired number of slip-in compartments by coupling together an appropriate number of members 3, the interlocked members are secured by laterally extending clamping bars 8. Clamping bars 8 essentially form a frame around the members. These clamping bars, however, are only secured to fastening flaps 6 of members 3 so that the upper part of the members remains free and thus are flexible. The terminating upper piece of material 9 is kept completely straight without any beveling and is covered over its entire lateral lengths by clamping bars 8. Since this terminating member only forms the back wall of the upper compartment, the previously mentioned considerations for forming the actual compartment do not aply with respect to it.

It is noted that the above description and the accompanying drawings are provided merely to present an exemplary embodiment of the present invention and that additional modifications of this embodiment are possible within the scope of this invention without deviating from the spirit thereof.

We claim:

1. A holder for data carriers which comprises a plurality of flexible, plastic members arranged adjacent one another; each member being of approximately rectangular shape so as to have top, side and a bottom edges and each having both a tongue projecting away from the bottom edge and a slot positioned above the tongue so as to extend in a lateral direction, each slot extending laterally at least the same length as the length of the tongue; said members being arranged such that the tongue of one member is inserted into a slot of an adjacent member so as to form holder compartments for data carriers therebetween; each member having fastening flaps projecting from both side edges thereof at a point near the bottom edge; each member having a beveled corner between the top edge and a side edge; and each member having a portion of the top edge bent outwardly at a slight angle away from a plane formed by the member; and securing means extending along both the side edges of the plurality of members and engagable with fastening flaps of each member to secure said members into a holder.

* * * * *